US005967560A

United States Patent [19]

Seidl

[11] Patent Number: 5,967,560

[45] Date of Patent: Oct. 19, 1999

[54] HANGING LABEL

[75] Inventor: Peter Seidl, Wie Postanschrift, Germany

[73] Assignee: Schreiner Etiketten und Selbstklebetechnik GmbH & Co., Oberscheissheim, Germany

[21] Appl. No.: 08/877,305

[22] Filed: Jun. 17, 1997

[51] Int. Cl.[6] ..... B42D 15/00

[52] U.S. Cl. ..... 283/81; 215/399

[58] Field of Search ..... 283/81, 900; 215/399; 248/311.3, 683, 693, 205.3; 40/310, 630, 306, 312, 617

[56] References Cited

U.S. PATENT DOCUMENTS

| | | | |
|---|---|---|---|
| 3,768,684 | 10/1973 | Buchtel | 248/359 X |
| 3,807,679 | 4/1974 | Burke et al. | 248/359 X |
| 5,135,125 | 8/1992 | Andel et al. | 40/310 X |
| 5,490,658 | 2/1996 | Coward et al. | 248/683 |
| 5,738,381 | 4/1998 | Trleaven et al. | 283/81 |
| 5,782,495 | 7/1998 | Grosskopf et al. | 283/81 |

FOREIGN PATENT DOCUMENTS

| | | |
|---|---|---|
| 0 356 574 B1 | 9/1988 | European Pat. Off. . |
| 0 356 574 | 3/1990 | European Pat. Off. . |
| 0 632 422 B1 | 4/1994 | European Pat. Off. . |
| 36 22 467 A1 | 1/1988 | Germany . |
| 91 01 464 | 6/1991 | Germany . |
| 92 02 956 U | 9/1992 | Germany . |
| 195 05 531 A1 | 8/1996 | Germany . |
| WO 92 15081 | 9/1992 | WIPO . |

*Primary Examiner*—Willmon Fidie, Jr.
*Attorney, Agent, or Firm*—Sixbey, Friedman, Leedom & Ferguson, P.C.; Donald R. Studebaker

[57] ABSTRACT

A label made of a rectangular layer comprises, as an integral part thereof, a suspension strap which is defined by a die cut line extending along most of the periphery of the layer between two roots at which the suspension strap remains joined to the remaining central portion of the label. The roots have a mutual distance of half a perimeter of the bottle to be labeled and the total length of the label is preferably approximately equal to the perimeter of the bottle. Preferably, one of the two roots is located near the leading edge of the label when this is applied to the bottle by an automatic dispenser. The label provides a large surface for printed information which is not interrupted by the suspension strap. Also a booklet may be attached to the label.

21 Claims, 4 Drawing Sheets

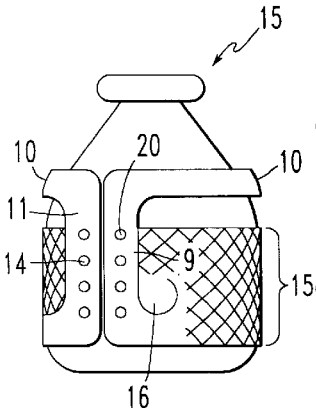
FIG. 10
FIG. 9
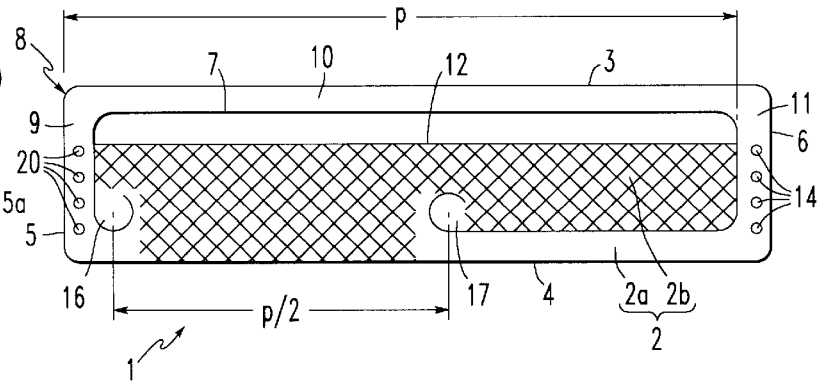
FIG. 11
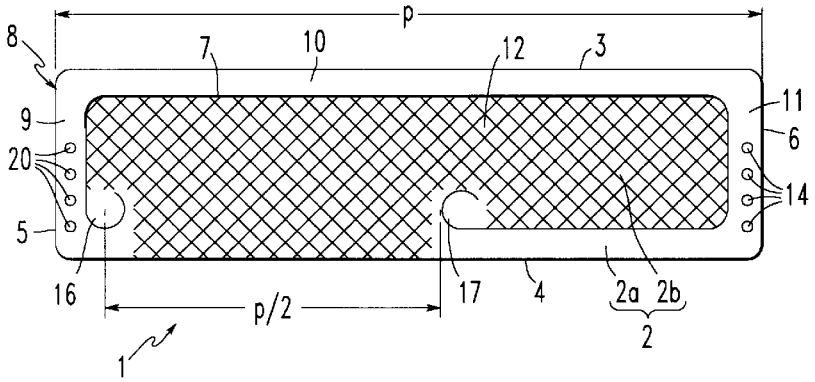
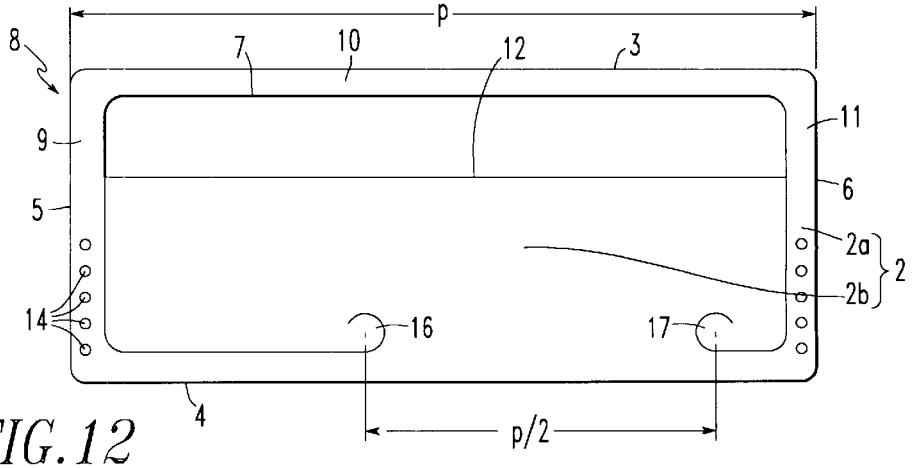
FIG. 12

HANGING LABEL

BACKGROUND OF THE INVENTION

1. Field of the Invention

The present invention relates generally to improvements in label devices, and particularly, to a label for attaching to a bottle containing a liquid and having a hanger for suspending the bottle.

2. Description of Related Art

International patent application publication WO 92/15081 discloses a hanging label for identifying the contents of intravenous bottles. The label comprises two layers of plastic material surrounding the bottle. A hanging ring is defined in the label by a pair of die cut lines which penetrate the upper layer of the label. This known label requires additional production costs in that it comprises two layers which must be bonded together by use of an adhesive. Pharmaceutical companies are nowadays faced more and more with the need to provide extensive instructions requiring a lot of space; which is often a problem if the product is contained in a small bottle. Space is also often required on the labels to permit a doctor to write patient information on the labels. However, the hanging ring of WO 92/15081 intersects the label surface at two places, and therefore, appreciably reduces the useful area available for information and instructions which is especially a problem if the hanging label should be used for a small bottle. A booklet containing further product information cannot be attached to the label, because it would impede the handling of the hanging ring.

European Patent EP 0 356 574 and laid open German Patent application DE 195 05 531 A1 each disclose hanging labels consisting of two superimposed bonded layers in which a transparent front layer has the form of a suspension strap. Those labels are particularly costly due to the material consumption for the two layers and the means for bonding them together securely. Further, those labels do not allow attachment of a booklet to the label which extends more than one half of the perimeter of a bottle to which the label is to be attached, because such a booklet would impede the handling of the suspension strap.

German utility model G 91 01 464 discloses a hanging label consisting of a single layer and having a die cut line which extends along that edge of the label which is close to the bottom of a bottle and to which the label is to be applied. The die-cut line defines a suspension strap which can be slipped over the bottom of the bottle for hanging the bottle upside down. The label, and hence the suspension strap, must have a length which is equal to half the perimeter of the bottle, and therefore, the hanging strap is short in comparison to the bottle and difficult to be handled.

European Patent EP 0 632 422 discloses a hanging label consisting of a single layer and having a closed loop, die-cut line defining a U-shaped suspension strap extending from that edge of the label which is close to the bottom of a bottle and to which the label is to be applied. In the production of this label, the material of the layer inside the U-shaped suspension strap is punched out, which results in a lot of waste.

SUMMARY OF THE INVENTION

It is therefore a principal object of the present invention to provide an improved label device provided with a suspension strap.

Another object of the present invention is to provide an improved hanging label which is typified by low cost, ease of application and use, and high versatility and adaptability.

A further object of the present invention is to provide a label device which provides a large continuous surface for information and instructions, which surface may extend along almost the whole perimeter of a bottle to be labeled.

Still another object of the present invention is to provide a label device which lends itself for combination with a booklet.

A still further object of the present invention is to provide a label device including a suspension strap which allows a precise perpendicular positioning of an infusion bottle hanging upside down from a intravenous stand.

Still another object of the present invention is to provide a label device which may be automatic applied to a bottle without difficulty.

The above and other objects of the present invention will become apparent from the following description taken in conjunction with the accompanying drawings which illustrate preferred embodiments of the invention.

According to the present invention, a label is provided which is attached to the cylindrical portion of a pharmaceutical container or bottle along its whole or almost of its whole perimeter. A suspension strap is defined at the peripheral portion of the label by a die cut line. The suspension strap has, therefore, an appreciable length and enables the precise perpendicular hanging of the pharmaceutical container in an upside down position. For this purpose, the roots of the hanging strap, i.e. the points where the hanging strap is joined to the remaining label, have a mutual distance of half a perimeter of the bottle, so that the roots of the hanging strap will be situated on diametrically opposed positions of the pharmaceutical bottle or container when the label is attached to it.

In accordance with a preferred form of the improved label, a further die cut line is provided parallel to the long edges of the base layer. This further die cut line is arranged in a distance to the second long edge, and defines together with the second long edge, the area of the label which can be used for printing of information. The further die cut line intersects the portions of the die cut line which extend along the short edges, and thus, forms a closed loop with the die cut line. Due to the forming of a closed loop, a portion of the base layer is punched out so that the central portion of the suspension strap is spaced apart from the remaining central main portion of the base layer. This embodiment has the following advantage: The label can be applied to the cylindrical portion of a pharmaceutical bottle in such a manner that it covers almost all of the cylindrical portion up to the tapered bottle neck. The suspension strap, which is, as explained above, spaced apart from the central main portion, is situated in the region of the tapered bottle neck of the bottle when the label is applied to the bottle. The suspension strap presents itself, for gripping from its rear side and its use is made evident per se without the need of any explanation.

Preferably, the overall length of the label in the direction of the first and the second long edges of the substantially rectangular base layer is approximately equal to the perimeter of the bottle.

However, it is preferable to design the total length even a little longer than the perimeter so that the side portions of the suspension strap overlap each other, when the label is attached to a bottle. Thereby, the useful area available for instructions and explanations on the label is further increased.

The hanging label according to the present invention lends itself especially to the attachment of a booklet to the base layer of the label because, in spite of providing a suspension strap for hanging the label, the usable area of the label is uninterrupted and therefore can be advantageously used for attaching a booklet. Such a booklet can contain a great deal of information required for administering the pharmaceutical product.

It is especially advantageous for pharmaceutical applications if the booklet containing useful information is firmly attached to the product so that it can not be confused or carelessly discarded when unpacking the pharmaceutical product.

Instead of using a booklet, according to an alternative construction, it may be advantageous to attach one or more additional layers to the base layer, for instance, by means of an adhesive. These additional layers can be used in similar fashion as such a booklet.

So, in summary, the improved hanging label is simple and inexpensive, easy to apply and use, and provides especially the possibility of a large area being available for information and instructions even on small bottles or containers.

BRIEF DESCRIPTION OF THE DRAWINGS

FIG. 9 is a plan view of an alternative embodiment of the label according to the invention;

FIG. 10 is an elevational view of an intravenous bottle with the label of FIG. 9 attached to it;

FIG. 11 is a plan view of a further alternative embodiment of the label according to the invention;

FIG. 12 is a plan view of a still further alternative embodiment of the label according to the invention;

DETAILED DESCRIPTION OF THE PREFERRED EMBODIMENTS

Figure 1:
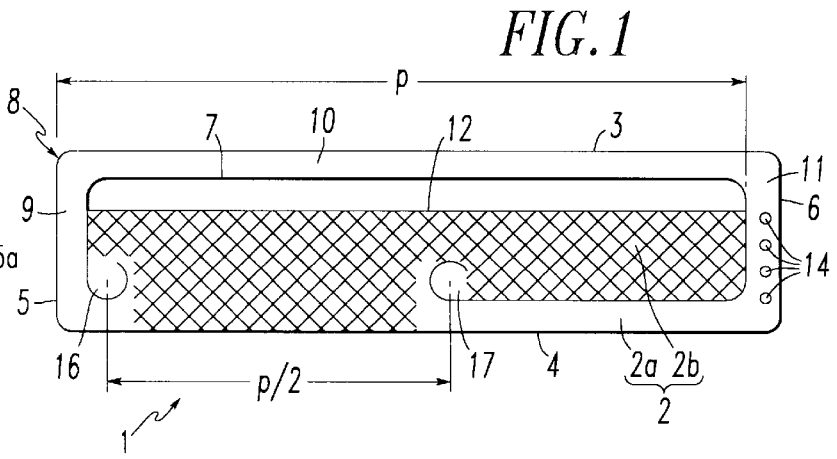
FIG. 1 is a plan view of a preferred label according to the invention.

FIG. 1 is a plan view of a preferred embodiment of the inventive label 1. Label 1 comprises a base layer 2 made of a plastic material, preferably polyester, of a thickness of 0.1 mm. The material must generally be strong enough to support a bottle. The base layer 2 is rectangular and has four rounded corners. The label has a first long edge 3 (shown at the upper side in the figure) and a second long edge 4 (shown as the lower edge in the figure). The label has a first short edge 5 (shown as the left edge in FIG. 1) and a second short edge 6 (shown as the right edge in FIG. 1).

A die cut line 7 is provided which originates at the corner between the first short edge 5 and the second long edge 4 (left bottom corner in the figure) and extends, parallel to the first short edge 5, to the first long edge 3, and follows the first long edge 3 at a substantially constant distance therefrom until it comes close to the second short edge 6. It then follows the second short edge 6 until it comes close to the second long edge 4 and follows, again, at a relative constant distance, the second long edge 4 until it terminates approximately in the middle of the second long edge 4.

The die cut line 7 defines a suspension strap 8 at the peripheral portion 2*a* of the base layer 2. Suspension strap 8 comprises a first side portion 9, a central portion 10, and a second side portion 11. The suspension strap 8 remains joined to the remaining central main portion 2*b* of base layer 2 at the end points of the die cut line 7. The end points thus define a first and a second root 16, 17 for the suspension strap 8. The first and the second root 16, 17 are spaced from each other by a distance p/2 which is approximately equal to half the perimeter of the bottle 15 to which the label 1 is to be attached, as is explained in detail below. The ends of the die cut line 7 are curved in order to relieve sheering stresses when a force is exerted on the suspension strap 8, e.g., when the bottle is hung upside down by means of the suspension strap.

A further die cut line 12 is provided which extends parallel to that part of the die cut line 7 defining the central portion 10 of the suspension strap 8. The further die cut line 12 is closer to the center of the label and intersects the die cut line 7 where the latter defines the first side portion 9 and the second side portion 11, respectively, thus forming a closed loop. That portion of the base layer 2 which is surrounded by the die cut line 7 and the further die cut line 12 is, therefore, detached from the label 1; in other words, the central portion 10 of the suspension strap 8 is in spaced relation to the remaining central main portion 2*b* of the base layer 2. Information for identifying the product and for providing instructions for handling the product contained in a bottle to which the label is to be attached may be provided on the front surface of the label as shown in FIG. 1 by the crisscross hatched area which extends over the central main portion 2*b* of the label and also into the space extend between the first and the second root 16, 17 to the second long edge 4. In other words the whole front surface of the label 1 can be used as a carrier for information with the exception of the suspension strap 8, which should preferably not be used for printing product information on it, because it is normally twisted, when it is used for hanging the bottle. An area for printing a serial number and an expiry date, for instance, may be reserved for the user. Information of that kind are usually printed on the label with a thermo-transfer printer or inkjet printer shortly before the individual label is attached to a bottle.

The label has a total length equal to the perimeter p of a bottle to which it is to be attached plus approximately the width of the second side portion 11.

Figure 2:
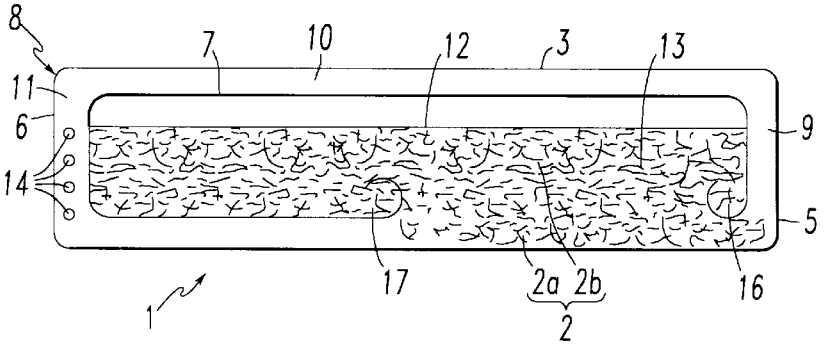
FIG. 2 is a plan view of the rear surface of the label of FIG. 1.

FIG. 2 is a plan view of the rear surface of the label already shown in FIG. 1. The rear surface is provided with a layer of pressure-sensitive adhesive 13 in order to provide a firm bond of the label to a bottle to which it is applied. The layer of pressure-sensitive adhesive 3 extends over the central main portion 2*b* of the label and into the region between the first and the second root 16, 17 until to the second long edge 4. The layer of pressure-sensitive adhesive also extends to a small part 21 of the first side portion 9 of the suspension strap 8, which forms the leading edge when the label is applied to a bottle, as will be described later. A small amount of pressure-sensitive adhesive is also applied to the back surface of the second side portion 6 of the suspension strap 8. This small amount of pressure sensitive adhesive is symbolized in the drawings of FIGS. 1 and 2 by four dots 14.

Figure 3:
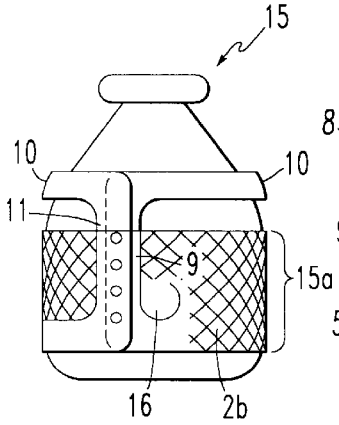
FIG. 3 is an elevational view of an intravenous bottle to which the label of FIG. 1 is attached.

FIG. 3 shows the label applied to an intravenous bottle 15. The label of FIG. 1 is wrapped around the cylindrical portion 15*a* of the intravenous infusion bottle 15 in such a manner that the central main portion 2*b* is firmly attached to the cylindrical portion 15*a* of the bottle 15 by means of the layer of pressure-sensitive adhesive 13. The central portion 10 of the suspension strap 8 is situated at the tapered bottle neck portion of the bottle 15 so that it remains space a small distance from the outer wall of the intravenous bottle.

As can be seen from FIG. 3, the first side portion 9 joins the central portion 10 of the suspension strap 8 to the first root 16. Since the total length of the label 1 in direction of the long edges 3 and 4 is equal to the perimeter of the intravenous bottle plus approximately the width of a side portion 9 or 11 of the suspension strap 8, the second side portion 11 overlaps the first side portion 9 as can be seen in FIG. 3. The second side portion 11 is secured on the first side portion 9 by means of the four dots 14 of pressure-sensitive adhesive. Instead of providing the four dots of pressure-sensitive adhesive on the rear surface of the second side portion 11, they could also be provided on the front surface of the first side portion 9, in order to secure the second side portion 11 on the first side portion 9.

Figure 4:
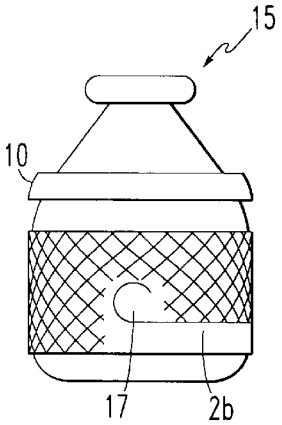
FIG. 4 is an elevational view of the bottle FIG. 3 as seen from a side opposite that of FIG. 3.

FIG. 4 shows the bottle of FIG. 3 seen from the "rear side" with respect to that shown in FIG. 3. In FIG. 4, the suspension strap 8 appears to be without connection to the central main portion 2*b* of the label 1 because its only connection is realized by side portions 9 and 11 which, however, are situated at the rear side and are therefore not visible in FIG. 4. However, FIG. 4 shows clearly the central main portion 2*b* of the label 1 which is attached to the cylindrical part 15*a* of intravenous bottle 15. Also, the second root 17 can be seen in FIG. 4. Second root 17 lies diametrically opposite the first root 16 (visible in FIG. 3) since both roots are spaced from each other by a distance which is equal to half the perimeter of the bottle.

Figure 5:
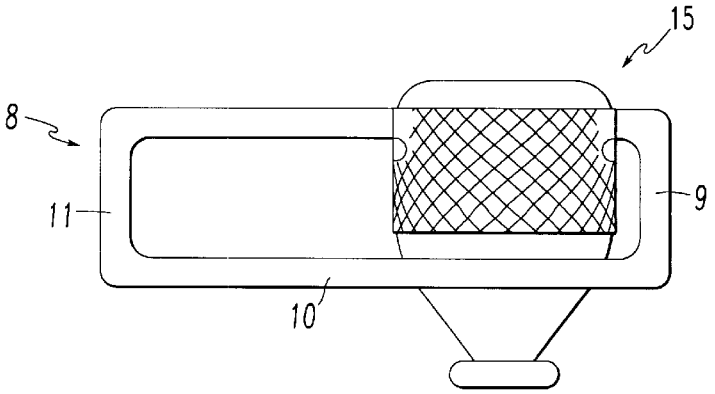
FIG. 5 shows the intravenous bottle of FIGS. 3 & 4 in an upside down position with the suspension strap peeled apart.
Figure 6:
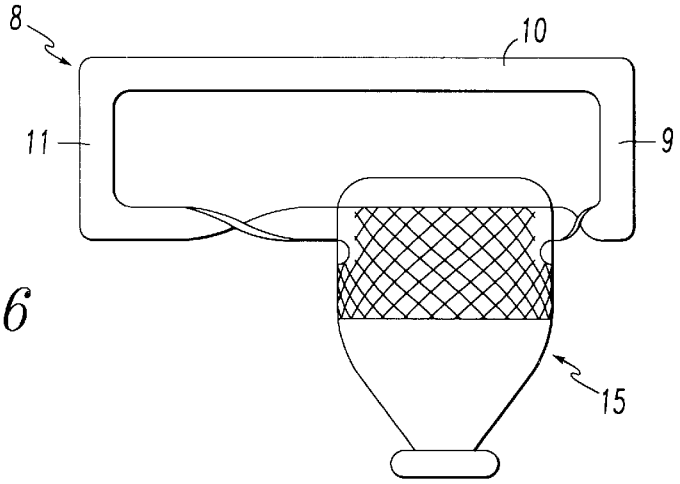
FIG. 6 shows the intravenous bottle of FIG. 1 in which the suspension strap is pivoted to its position ready for hanging the bottle to an intravenous stand.

In order to use the embodiment for an intravenous infusion, the connection between the first side portion 9 and the second side portion 11, which is realized by dots 14 of pressure-sensitive adhesive, can be broken easily by gripping and pulling the suspension strap 8. As a result, the suspension strap unwraps from the bottle as shown in FIG. 5, which shows the intravenous bottle 15 in an upside down position (as it is used for dispensing the infusion) with the unwrapped rectangular suspension strap 8. The suspension strap may then be twisted over the base of the bottle as shown in FIG. 6 and a hook of an intravenous stand (not shown) may be inserted between the suspension strap and the bottle 15 for suspending the bottle upside down from the suspension strap 8. The suspension strap is thereby stretched into the form of an inverted V (not shown).

As it becomes apparent from the above description, there is no need to pivot the suspension strap 8 over the head of the bottle 15, and therefore, the unwrapping of the suspension strap is in no way impeded by an infusion hose which may be already inserted into the mouth of the bottle 15. Thus, the handling of the intravenous bottle 15 remains the same as described above, even if an infusion tube is connected to the mouth of the bottle before the suspension strap 8 is peeled apart from the bottle 15.

Figure 7:
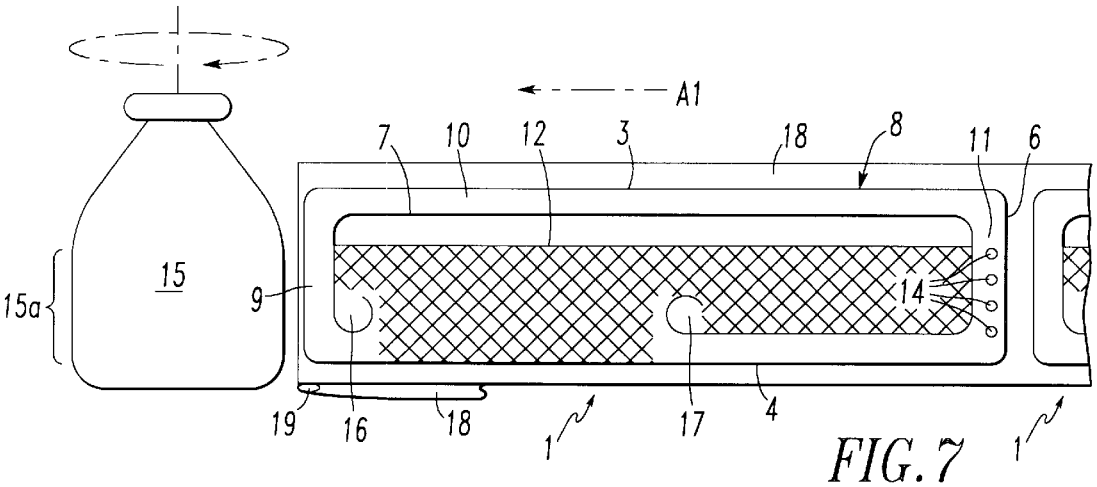
FIGS. 7 & 8 illustrate the process of attaching the label according to the invention to an intravenous bottle.

FIG. 7 illustrates a method of applying a label 1 according to the invention to the intravenous infusion bottle 15. The labels 1 are provided on a carrier web 18 which is coated with a release layer so that the labels 1 stick to the carrier web 18 with only a small adhesion force. The labels 1 are arranged on the carrier web 18 with the short edge 9 of one label adjacent the short edge 11 of the next label 1. The carrier web 18 and the labels 1 disposed on it move in direction of arrow A1 towards to the intravenous bottle 15 which is to be labeled. The carrier web 18 is drawn over an edge 19 having a small radius so that the label 1 does not follow the bending movement of the carrier web 18 around the edge 19, but rather continues its straight movement and comes close to the intravenous bottle 15.

The intravenous bottle 15 is supported on rotating rollers (not shown) and is rotated in a direction of arrow A2 with a circumferential speed which is approximately equal to the speed of advance of the carrier web 18. The label, which is arranged on carrier web 18 with the first side portion 9 as the leading edge, comes in contact with the rotating intravenous bottle 15. Since there is provided a small part 21 of pressure-sensitive adhesive at the rear surface of the first side portion 9 (see, FIG. 2), the label 1 sticks to the cylindrical portion 15*a* of the intravenous bottle 15 and follows its movement and is wrapped around the bottle 15.

It is important that the first side portion 9 of the suspension strap 8 which is directly joined to the first root 16 constitutes the leading edge in order that the label 1 is pulled by the bottle 15 without any distortions which would occur if the label 1 first comes in contact with the bottle 15 at the second side portion 11 of the suspension strap 8 which has a much longer, and therefore, more unstable connection to the second root 17.

Figure 8:
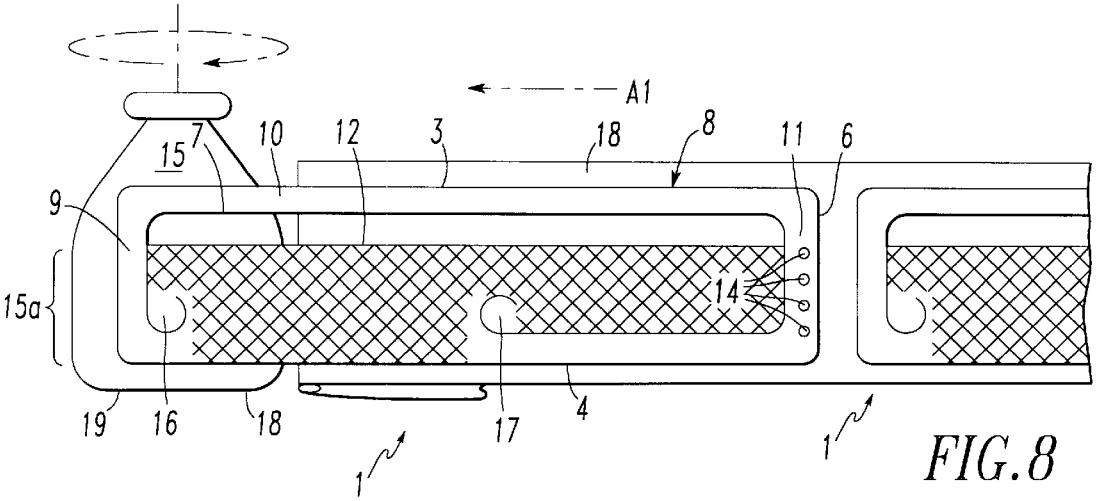

FIG. 8 shows the situation in which the label 1 has been partially affixed to the intravenous bottle 15. The label is then pressed onto the cylindrical portion 15*a* of the intravenous bottle 15 by a roller (which has been omitted from the figure for the sake of clarity), so that the label is properly applied to the bottle. When the bottle 15 has completed one turn, the trailing edge, namely the second side portion 11, comes in contact with the first side portion and is affixed to it by means of the dots 14 of pressure-sensitive adhesive shown in FIG. 1.

FIG. 9 is a plan view of a further embodiment of the new label 1 which comprises a base layer 2 which is rectangular and has four rounded corners. The label has a first long edge 3 and a second long edge 4. The label has a first short edge 5 and a second short edge 6. A die cut line 7 is provided which originates at the corner between the first short edge 5 and the second long edge 4 and extends, parallel to the first short edge 5, to the first long edge 3 and then follows the first long edge 3 at a substantially constant distance until it comes close to the second short edge 6. From there, the cut line follows the second short edge 6 until it comes again close to the second long edge 4, which it follows, again at relatively constant distance therefrom, until it terminates approximately in the middle of the second long edge 4. The die cut line 7 defines a suspension strap 8 at the peripheral portion 2*a* of the base layer 2 comprising a first side portion 9, a central portion 10, and a second side portion 11. The suspension strap 8 remains joined to the remaining central main portion 2*b* of base layer 2 at the end points of the die cut line 7. The end points thus define a first and a second root 16, 17 for the suspension strap 8. The first and the second root 16, 17 are spaced from each other by a distance p/2 which is approximately equal to half the perimeter of the bottle 15 to which the label 1 is to be attached. The ends of the die cut line 7 are curved in order to relieve sheering stresses when a force is exerted on the suspension strap 8.

Pressure-sensitive adhesive is applied to the back surface of base layer 2, as shown in FIG. 2, with regard to the first embodiment. A small amount of pressure-sensitive adhesive is also applied to the back surface of the first and the second side portions 9, 11 of the suspension strap 8. These small amounts of pressure-sensitive adhesive are symbolized in FIG. 9 by four dots 14 on side portion 11 and four other dots 20 on side portion 9.

A second die cut line 12 is provided which extends parallel to that part of the die cut line 7 which defines the central portion 10 of the suspension strap 8. The second die cut line 12 is closer to the center of the label and intersects the die cut line 7 where the latter defines the first side portion 9 and the second side portion 11, respectively, thus forming a closed loop. That portion of the base layer 2 which is surrounded by the die cut line 7 and the further die cut line 12 is therefore detached from the label 1; in other words, the central portion 10 of the suspension strap 8 is in spaced relation to the central main portion 2*b* of the base layer 2.

Information for identifying the product and providing instructions for handling the product contained in a bottle to which the label is to be attached may be provided on the front surface of the label as shown in FIGS. 9 & 10 by the crisscross hatched area which extends over the central main portion 2*b* of the label and also extends between the first and the second root 16, 17 to the second long edge 4. In other words, the whole front surface of the label 1 can be used as a carrier for information with the exception of the suspension strap 8 which should preferably not be used for printing product information on it, because it is normally twisted, when it is used for hanging the bottle.

An area for printing a serial number and an expiration date, for instance, may be reserved for the user. Information of that kind are usually printed on the label with a thermo-transfer printer or inkjet printer shortly before the individual label is attached to a bottle.

The label has a total length approximately equal to the perimeter p of a bottle to which it is to be attached.

FIG. 10 shows the label applied to an intravenous bottle 15. The label of FIG. 9 is wrapped around the cylindrical portion 15*a* of the intravenous infusion bottle 15 in such a manner that the central main portion 2*b* is firmly attached to the cylindrical portion 15*a* of the bottle 15 by means of the layer of pressure-sensitive adhesive 13. The central portion 10 of the suspension strap 8 is situated at the tapered bottle neck portion of the bottle 15 so that it remains a small distance from the outer wall of the intravenous bottle.

As can be seen from FIG. 10, the first side portion 9 joins the central portion 10 of the suspension strap 8 to the first root 16. Since the total length of the label 1 in the direction of its long edges 3 and 4 is equal to the perimeter of the intravenous bottle, the outer edge of the second side portion 11 is adjacent to the outer edge of the first side portion 9, as can be seen in FIG. 10. The first side portion 9 and the second side portion 11 are secured to the bottle by means of the four dots 14 of pressure-sensitive adhesive and four further dots 20 of pressure-sensitive adhesive, respectively.

FIG. 11 is a plan view of a further alternative embodiment of the label according to the invention. The label is constructed and handled in the same way as the label of FIG. 9, the only difference being that it is not provided with a second die cut line and it this, therefore, easier to manufacture. Due to the fact that there is no further die cut line (i.e., a die cut line 12 as in FIG. 9), the central portion 10 of the suspension strap 8 is immediately contiguous to the central main portion 2*b* of the base layer 2.

FIG. 12 is a plan view of a still further embodiment of the new label 1 which comprises a base layer of plastic material which is rectangular and has four rounded corners. The label has a first long edge 3 and a second long edge 4 as well as a first short edge 5 and a second short edge 6. A die cut line 7 is provided which originates from a region close to the corner between the second short edge 6 and the second long edge 4 (right bottom corner in the drawing). Contrary to the other embodiments described so far, the die cut line 7 does not originate exactly at a corner but only close to it. The die cut line extends, parallel to the second long edge 4, to the second short edge 6 and then follows it at a substantially constant distance until it comes close to the first long edge 3. The die cut line then follows the first long edge 3 until it comes close to the first short edge 5, which it follows at a relatively constant distance until it comes close to the second long edge 4. Then, the cut line 7 runs along the second long edge 4 until it terminates approximately in the middle of the second long edge 4. The die cut line 7 defines a suspension strap 8, at the peripheral portion 2*a* of the base layer 2, which comprises a first side portion 9, a central portion 10, and a second side portion 11. The suspension strap 8 remains joined to the remaining central main portion 2*b* of base layer 2 at the end points of the die cut line 7. The end points thus define a first and a second root 16, 17 for the suspension strap 8. The first and the second root 16, 17 are spaced from each other by a distance p/2 which is approximately equal to half the perimeter of the bottle 15 to which the label 1 is to be attached. The ends of the die cut line 7 are curved in order to relieve sheering stresses when a force is exerted on the suspension strap 8.

A second die cut line 12 is provided which extends parallel to that part of the die cut line 7 defining the central portion 10 of the suspension strap 8. The further die cut line 12 is closer to the center of the label and intersects the die cut line 7 where the latter defines the first side portion 9 and the second side portion 11, respectively, thus forming a closed loop. That portion of the base layer 2 which is surrounded by the die cut line 7 and the second die cut line 12 is, therefore, detached from the label 1; in other words, the central portion 10 of the suspension strap 8 is in spaced relation to the central main portion 2*b* of the base layer 2.

The label has a total length equal to the perimeter p of a bottle to which it is to be attached plus approximately the width of the second side portion 11. It is processed, i.e. attached to a bottle, in much the same way as the label of FIG. 1. However, the label of FIG. 12 must be processed in such a manner that the second short edge 6 constitutes the leading edge, i.e. the edge which comes first in contact with the bottle to be labeled, because the second side portion 11 at the second short edge 6 is situated close to the root 17 an is therefore held in a stable condition necessary for the labeling process.

Figure 13:
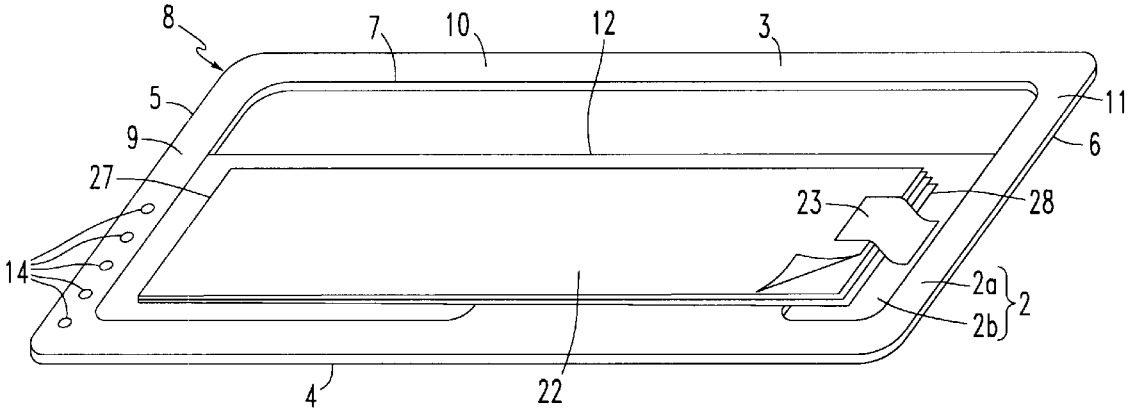
FIG. 13 is a perspective view of the label of FIG. 12, with a booklet attached to it.

FIG. 13 shows the label of FIG. 12 in a perspective view. A booklet 22 is attached to the central main portion 2*b* of the label 1. The booklet is attached to the label in such a manner that it is not superimposed on the peripheral suspension strap 8, so that handling of the booklet does not interfere in any way with the handling of the suspension strap 8.

The booklet may contain several pages which are stapled together or are bonded together at its spine 27 by means of an adhesive. The undermost page of the booklet is affixed to the label by means of an adhesive. The booklet is kept closed by means of an adhesive strip 23 which is affixed at one of its ends to the cover page of the booklet close to its book edge 28 and at its other end to the base layer 2.

In order to open the booklet 22 and read information from it, the adhesive strip 23 can be released from the base layer 2 of the label 1, and after having read the booklet 22, the adhesive strip can be attached to the base layer 2 again in order to re-close the booklet 22.

Needless to say, all pages of the booklet, including the uppermost cover page, as well as the front surface of the base layer 2 can be provided with printed information.

Figure 14:
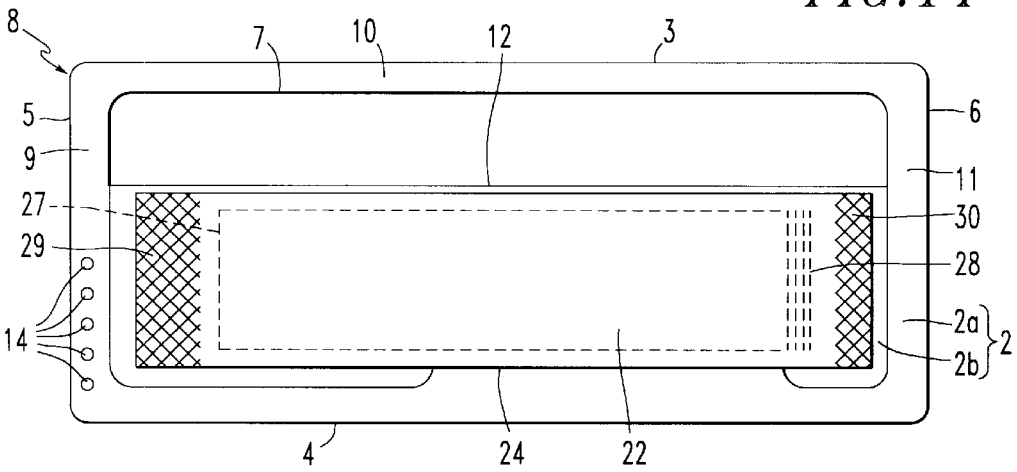
FIG. 14 is a plan view of the label of FIG. 12 with a booklet attached to it in an alternative manner.

FIG. 14 shows again the label of FIG. 12, however, combined with a booklet 22 in an alternative manner. The booklet 22 of FIG. 14 has a spine 27 and a book edge 28 over which a closure strip 24 is applied that extends beyond the spine 27 of the booklet at one end and beyond the book edge 28 of the booklet 22 at the other end. The end portion 29 (crisscross-hatched in the figure) of the closure strip 24, which extends beyond the spine 27 of the booklet 22 is provided with a permanent adhesive at its underside so that it is firmly and permanently fixed to the central main portion 2*b* of the label. The opposite end portion 30 of the closure strip 24, which extends beyond the book edge 28 of the booklet 22, is provided with a releasable adhesive (crisscross-hatched area) so that it can be removed for opening the booklet 22 and it can be re-affixed to the base layer 2 in order to close the booklet again. Apart from the end portions 29 and 30 the closure strip is free of adhesive. The booklet is not bonded to the base layer 1 so that it may be removed from the label for the purpose of reading it.

Figure 15:
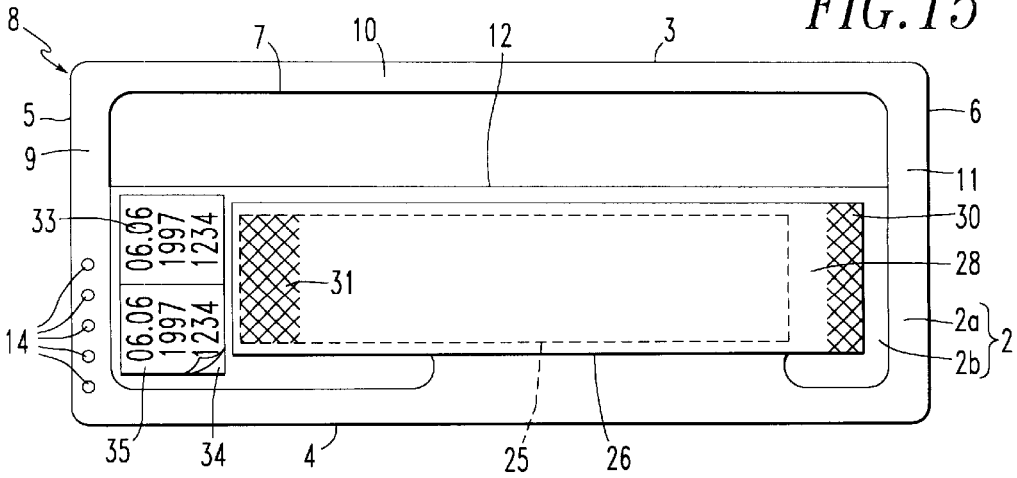
FIG. 15 is a plan view of the label of FIG. 12 with two additional layers and a detachable portion.

According to the embodiment shown in FIG. 15 in a plan view, the label of FIG. 12 is provided with additional layers which serve as carriers for information, e.g., as shown in FIG. 15, there are provided two additional layers, a first layer 25, which is the bottommost layer, and a second layer 26, which is the uppermost layer. The bottommost layer 25 is in contact with and bonded to the base layer 2 of the label 1 by means of a permanent adhesive applied to the underside of one end portion 31 (crisscross-hatched in FIG. 15). The second layer 26 is bonded onto the first layer 25 by means of a layer of permanent adhesive much in the same way as the first layer is bonded to the base layer 2. However, the second layer is larger so that it extends beyond the adhesive-free end portion of the first layer 25. That end portion 32 (crisscross-hatched in FIG. 15) of the second layer 26 which extends beyond the adhesive-free end portion of the first layer 25 is provided with a releasable adhesive on its underside facing the base layer 2, so that the two additional layers 25, 26 remain firmly attached to the base layer 2 of the label 1.

In order to access the rear surface of the second layer 26, the front surface of the first layer 25, the rear surface of the first layer 25, and the central main portion 2*b* of the base layer 2, for reading information there, the second layer 26 can be easily peeled apart at the end portion 32 which provided with the releasable adhesive and folded back. After having read the information, the second layer 26 can be re-affixed to the central main portion 2*b* of the base layer 2. Further layers of the same type as the first layer 25 can be provided if additional space for information is required.

The label of FIG. 15 is further provided with an area 33 which can be imprinted by the user of the label, e.g. a pharmaceutical company, with a serial number and/or an expiration date, for instance, symbolized in FIG. 15 by "06.06.1997 1234"

The label of FIG. 15 is further provided with an area coated with an adhesive-repellant release layer 34 on the front surface of the central main portion 2*b* of the base layer 2. This release layer is covered by a detachable layer 35 of plastic material or has a paper provided with a layer of pressure-sensitive adhesive at its surface facing the base layer 2. This detachable layer may carry on its front surface the same or a different imprint as the area 33. The detachable layer 35 can be easily removed, because it is arranged on the release layer 34, and can then be pasted onto an index-card or a similar object in order to make the data imprinted on it available there. Since the detachable layer 35 was arranged on the release layer 34, its layer of pressure-sensitive adhesive remains tacky and it, therefore, sticks securely on the surface of said index-card or a similar object onto which it is pasted later.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

What is claimed is:

1. A label for attaching to a bottle having a cylindrical portion of a defined perimeter, said label having means for suspending the bottle to which it is attached and comprises:

a substantially rectangular base layer having a central main portion and a peripheral portion, a first long edge and a second long edge, said long edges being susubstantially parallel to each other, a first short edge and a second short edge, said short edges being perpendicular to said first and said second long edges, and front and back surfaces;

a layer of pressure-sensitive adhesive applied to at least part of said back surface; and a die cut line at a peripheral portion of said substantially rectangular base layer, said die cut line extending between a first root and a second root in a manner defining a suspension strap of substantially constant width which remains joined to said central main portion of said base layer at said first and said second roots;

wherein said suspension strap has at least a central portion extending along said first long edge and a first and a second side portion extending along said first and said second short edge, respectively, said first and said second root being located at said second long edge and being separated from each other by a distance which is approximately one half of said perimeter of said bottle.

2. The label according to claim 1, wherein said first root is located close to a corner between said second long edge and said first short edge.

3. The label according to claim 1, wherein a second die cut line is provided parallel to said first long edge of said base layer, said further die cut line forming a closed loop with the die cut line at the peripheral portion of said substantially rectangular base layer.

4. The label according to claim 1, wherein an overall length of the label in a direction of said first and second long edges is approximately equal to the perimeter of said bottle.

5. The label according to claim 4, wherein an overall length of the label in a direction of said first and said second long edges is equal to a sum of the perimeter of said bottle plus approximately the width of one of said side portions of said suspension strap.

6. The label according to claim 1, wherein said die cut line has curved ends at said first and said second roots.

7. The label according to claim 6, wherein said curved ends are directed inwardly toward the central main portion of said base layer and have the form of an arch extending over more than 180°.

8. The label according to claim 1, wherein said layer of pressure-sensitive adhesive is applied selectively to said back surface in such a manner that at least most of said suspension strap remains free of adhesive.

9. The label according to claim 1, wherein said layer of pressure-sensitive adhesive is applied to said entire back surface and is coated in an area of at least most of said suspension strap with a non-adhesive substance.

10. The label according to claim 1, wherein a small amount of adhesive is provided on said back surface of said first side portion.

11. The label according to claim 1, wherein a small amount of adhesive is provided on said back surface of said second side portion.

12. The label according to claim 1, wherein a booklet is attached to said front surface of said central main portion of said base layer.

13. The label according to claim 12, wherein said booklet is attached to said base layer by means of an adhesive.

14. The label according to claim 12, wherein said booklet is kept closed by means of a strip overlying said booklet and being provided with a permanent adhesive at a first end portion and with a releasable adhesive on surface of an opposite second end portion which faces said base layer.

15. The label according to claim 1, wherein at least one additional layer is attached to said front surface of said central main portion of said base layer, said additional layer being provided with a permanent adhesive at a first end portion and with a releasable adhesive on a surface of an opposite second end portion which faces said base layer.

16. The label according to claim 1, wherein a first additional layer is attached to said front surface of said central main portion of said base layer by means of a permanent adhesive applied to an end portion of a surface of the first additional layer which faces said base layer; and wherein a second additional layer is attached to said first additional layer by means of a permanent adhesive applied to a first end portion of a surface of the second additional layer which faces said first additional layer, superimposed to said end portion of said first additional layer; and wherein said second additional layer is larger than said first additional layer so that the first additional layer has a second end portion which is in contact with said front surface of said base layer, said second end portion being provided with a releasable adhesive.

17. The label according to claim 1, wherein several additional layers are attached to said front surface of said central main portion of said base layer in superimposed relation to each other by means of a permanent adhesive applied to a respective end portion of their surfaces directed towards said base layer; and wherein an additional cover layer is attached to said first additional layer by means of a permanent adhesive applied to a first end portion of a surface of the cover layer that is directed towards said several additional layers, superimposed to said end portions of said several additional layers, said additional cover layer being larger than said several additional layers so that it has a second end portion which is in contact with said front surface of said base layer, which second end portion is provided with a releasable adhesive.

18. The label according to claim 1, wherein an area is provided which can be imprinted by a user applying the label.

19. The label according to claim 1, wherein a part of said base layer is provided with a coating of an adhesive-repellant release layer and a detachable layer coated with a pressure-sensitive adhesive is attached to said adhesive-repellant release layer.

20. The label according to claim 1, wherein said back surface of said suspension strap is substantially void of adhesive.

21. A label for attaching to a bottle having a cylindrical portion of a defined perimeter, said label having means for suspending the bottle to which it is attached and comprises:

a substantially rectangular base layer having a central main portion and a peripheral edge;

a first long edge and a second long edge, said long edges being substantially parallel to each other;

a first short edge and a second short edge, said short edges being perpendicular to said first and said second long edges; and front and back surfaces;

a layer of pressure sensitive adhesive applied to at least part of said back surface; and a die cut line at a peripheral portion of said substantially rectangular base layer, said die cut line extending parallel to said peripheral edge between a first root and a second root in a manner defining a suspension strap of substantially constant width that remains joined to said central main portion of said base layer at said first and said second roots;

wherein said suspension strap has an outer side and an inner side, and at least a central portion extending along said first long edge and a first and a second side portion extending along said first and said second short edge, respectively, said first and said second root being located at said second long edge and being separated from each other by a distance that is approximately one half of said perimeter of the bottle with said suspension strap being defined on said inner side by said die cut line, and defined on said outer side by said peripheral edge of said base rectangular layer.

* * * * *